US005370380A

United States Patent [19]

Suzuki et al.

[11] Patent Number: 5,370,380

[45] Date of Patent: Dec. 6, 1994

[54] SHEET FEEDING APPARATUS

[75] Inventors: Tetsuo Suzuki, Yokohama; Shinnosuke Taniishi; Junichi Asano, both of Kawasaki; Soichi Hiramatsu; Haruyuki Yanagi, both of Yokohama; Takashi Nojima, Tokyo; Satoshi Saikawa, Inagi, all of Japan

[73] Assignee: Canon Kabushiki Kaisha, Tokyo, Japan

[21] Appl. No.: 223,815

[22] Filed: Apr. 6, 1994

Related U.S. Application Data

[63] Continuation of Ser. No. 916,676, Jul. 22, 1992, abandoned.

[30] Foreign Application Priority Data

Jul. 25, 1991 [JP] Japan ..... 3-186398

[51] Int. Cl.[5] ..... B65H 3/56

[52] U.S. Cl. ..... 271/21; 271/24; 271/117; 271/121; 271/127; 271/164

[58] Field of Search ..... 271/22, 117, 127, 157, 271/164, 19, 20, 21, 24, 25, 121

[56] References Cited

U.S. PATENT DOCUMENTS 4,023,792 5/1977 Punnett ..... 271/22
4,595,191 6/1986 Uchiyama ..... 271/170
4,772,007 9/1988 Kashimura ..... 271/22
5,114,133 5/1992 Osada ..... 271/22
5,145,160 9/1992 Nagashima ..... 271/9

FOREIGN PATENT DOCUMENTS 0251819 1/1988 European Pat. Off. .
2276737 11/1990 Japan .

*Primary Examiner*—Richard A. Schacher
*Attorney, Agent, or Firm*—Fitzpatrick, Cella, Harper & Scinto

[57] ABSTRACT

A sheet feeding apparatus includes a sheet supporting device for supporting sheets, a supply device for feeding the sheets supported by the sheet supporting device in a sheet feeding direction, a separating claw device for separating, one-by-one, the sheets fed by the supply device by regulating at least one front corner of the sheets relative to the sheet feeding direction. A switching device selectively switches positions of the separating claw device between a first position where the separating claw device is separated from the sheet supporting device and a second position where the separating claw device is adjacent to the sheet supporting device. A separation device separates, one-by-one, the sheets fed by the supply device in a condition that the separating claw device is in the second position.

32 Claims, 6 Drawing Sheets

SHEET FEEDING APPARATUS

This application is a continuation of application Ser. No. 07/916,676, filed Jul. 22, 1992, now abandoned.

BACKGROUND OF THE INVENTION

1. Field of the Invention

The present invention relates to a sheet feeding apparatus for separating and feeding out stacked recording media (sheets) one by one to a recording portion or other portions.

2. Description of the Related Art

Nowadays, pursuant to the remarkable progress of information processing equipment, various recording systems such as printers, electronic typewriters and the like have been used in various offices. In such recording systems, plain paper sheets and/or thicker sheets such as post cards, envelopes and the like are used as recording media, and the recording media can be manually inserted and/or can be automatically supplied to a recording portion by an automatic sheet feeding apparatus. To this end, the recording system is provided with a manual sheet insertion opening and a sheet supply opening for the automatic sheet feeding apparatus to cope with various recording media. Further, since the above-mentioned automatic sheet feeding apparatus are generally of a separating claw type which can be made inexpensive, the kind of recording media which can be stably separated is limited to the plain paper sheet alone. Thus, in order to supply or feed the thicker sheets such as post cards, envelopes and the like, an exclusive automatic sheet feeding apparatus of other separation type, for example, of a friction separation type must be used.

However, in the conventional cases, when the plain paper sheets and the thicker sheets such as post cards are to be used each in its proper way as the recording media, the corresponding automatic sheet feeding apparatuses must be exchanged with respect to the recording system each time, thus worsening the operability and requiring an additional installation space for the dismounted automatic sheet feeding apparatus.

Further, even when the automatic sheet feeding apparatus for the plain paper sheets is incorporated into the recording system and only the automatic sheet feeding apparatus for the thicker sheets is detachably mountable within the recording system, since the recording system itself becomes large-sized, the installation space for the recording system will be increased. Furthermore, since at least two automatic sheet feeding apparatuses are required the overall recording facilities will be expensive. In addition, since not only the sheet supply opening for the automatic sheet feeding apparatus but also the manual sheet insertion opening are required, the overall recording system becomes large-sized and expensive.

SUMMARY OF THE INVENTION

The present invention aims to eliminate the above-mentioned conventional drawbacks, and an object of the present invention is to provide an automatic sheet feeding apparatus which can feed or supply not only plain paper sheets but also thicker sheets such as post cards, envelopes and the like without using plural automatic sheet feeding apparatuses, and to permit the manual sheet insertion with such a automatic sheet feeding apparatus.

In order to achieve the above object, the prevent invention provides a sheet feeding apparatus comprising a sheet supporting means for supporting sheets, a supply means for feeding out the sheets supported by the sheet supporting means, a separating claw means for separating the sheets fed out by the supply means one by one by regulating front corners (in a sheet feeding direction) of the sheets supported by the sheet supporting means, a switching means for selectively switching positions between a first position where the separating claw means is separated from the sheet supporting means and a second or retard position where the separating claw means is retarded toward the sheet supporting means. A separation means separates the sheets one by one when the sheets supported by the sheet supporting means are fed out by the supply means in a condition that the separating claw means is in the retard position.

With this arrangement, when the separating claw means is positioned in the first position where it is separated from the sheet supporting means, the sheets can be supplied from the sheet supporting means and the sheets can be separated by the separating claw means. On the other hand, when the separating claw means is positioned in the retard position, the sheets can be fed over the separating claw means and can be separated one by one by the separation means without the resistance of the separating claw means.

In this way, the plain paper sheets can be separated and supplied by the separating claw means, and the sheet having the greater ridigity such as thicker sheets which cannot be separated by the separating claw means can be separated and supplied by the separation means. Accordingly, it is possible to separate and feed the plural kinds of sheets only with a single sheet feeding apparatus.

Incidentally, the separation means preferably includes abutment plates so that the sheets are separated one by one by riding the sheet over the abutment plates against which leading ends of the sheets are abutted by the supply means.

DETAILED DESCRIPTION OF THE PREFERRED EMBODIMENTS

The present invention will now be explained with reference to the accompanying drawings.

Figure 1:
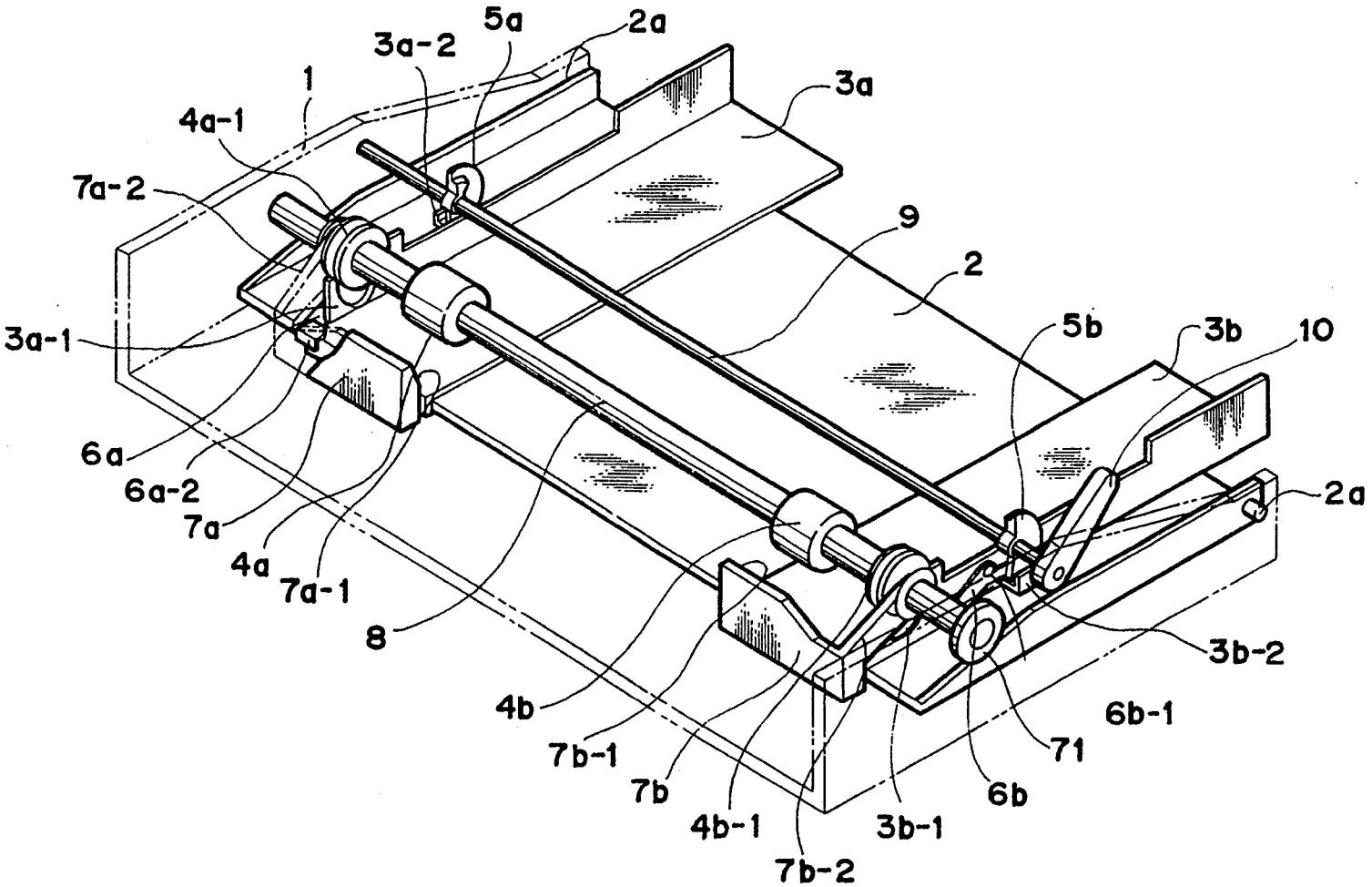
FIG. 1 is a perspective view of a sheet feeding apparatus according to a preferred embodiment of the present invention.
Figure 2:
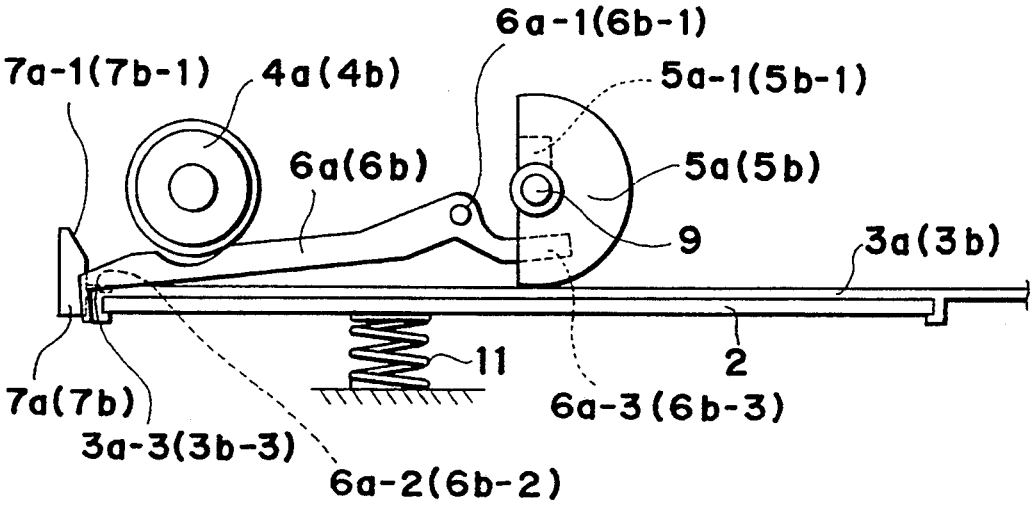
FIG. 2 is an elevational sectional view of the apparatus of FIG. 1.

FIG. 1 is a perspective view of a sheet feeding apparatus according to a first embodiment of the present invention, and FIG. 2 is an elevational sectional view of a main portion of the apparatus of FIG. 1.

In FIGS. 1 and 2, a frame 1 serves to support a sheet feeding mechanism, and sheet supply rollers 4*a*, 4*b* are mounted on a sheet supply shaft 8 in such a manner that they can slide along the sheet supply shaft and a rotational force is supplied to these rollers via the sheet supply shaft. The sheet supply rollers 4*a*, 4*b* are provided with grooves 4*a*-1, 4*b*-1, respectively, by which U-shaped recessed portions 3*a*-1, 3*b*-1 of sheet regulating guides 3*a*, 3*b* (described later) are engaged, so that, when the sheet regulating guides 3*a*, 3*b* are slid, the supply rollers 4*a*, 4*b* are also slid along the shaft through the engagement between the grooves and the recessed portions. A drive gear 71 secured to one end of the sheet supply shaft 8 serves to transmit a driving force from a motor (not shown) to the sheet supply shaft 8.

A pressure plate 2 for urging stacked recording media (referred to as "sheets" hereinafter) against the sheet supply rollers 4*a*, 4*b* is pivotally mounted on the frame via pins 2*a* and is normally biased toward the sheet supply rollers 4*a*, 4*b* via a pressure spring 11. The sheet regulating guides 3*a*, 3*b* for regulating lateral edges of the sheets are mounted on the pressure plate 2 for sliding movement in a widthwise direction of the sheet, and are provided with cam receiving portions 3*a*-2, 3*b*-2, respectively, against which release cams 5*a*, 5*b* (described later) can be abutted when the cams are rotated. When the release cams 5*a*, 5*b* are abutted against the cam receiving portions 3*a*-2, 3*b*-2, the pressure plate 2 is pushed down to separate from the sheet supply rollers 4*a*, 4*b*, together with the sheet regulating guides 3*a*, 3*b*.

Separating claws 6*a*, 6*b* are provided at their front corners (in a sheet feeding direction) with claw portions 6*a*-2, 6*b*-2 by which the sheets are held down. The separating claws 6*a*, 6*b* are pivotally mounted via pivot pins 6*a*-1, 6*b*-1 and are normally abutted against the pressure plate 2 by their own weights. In this embodiment, while the separating claws were abutted against the pressure plate by their own weights, in such a case where the sheet feeding apparatus is installed in an inclined posture, the separating claws may positively be biased toward the pressure plate 2 by means of a spring and the like. Further, on the other ends of the separating claws 6*a*, 6*b* remote from the claw portions 6*a*-2, 6*b*-2, there are provided push-down portions 6*a*-3, 6*b*-3 against which claw opening cams 5*a*-1, 5*b*-1 formed on the release cams 5*a*, 5*b* can be abutted. When the push-down portions 6*a*-3, 6*b*-3 are pushed down by the rotation of the release cams 5*a*, 5*b*, the separating claw 6*a*, 6*b* are rotated around the pivot pins 6*a*-1, 6*b*-1, thereby separating the claw portions 6*a*-2, 6*b*-2 (opposite to the push-down portions 6*a*-3, 6*b*-3) from the pressure plate 2 to reach a claw opening condition.

Incidentally, since the sheet regulating guides 3*a*, 3*b* are provided with recessed portions 3*a*-3, 3*b*-3 for receiving the claw portions 6*a*-2, 6*b*-2; so that the claw portions 6*a*-2, 6*b*-2 of the separating claws 6*a*, 6*b* do not protrude from sheet passing surfaces of the sheet regulating guides 3*a*, 3*b* in a condition that the separating claws 6*a*, 6*b* are abutted against, or adjacent to, the pressure plate 2, even when the sheets are set on the pressure plate, the corners of the sheets are not caught by the claw portions 6*a*-2, 6*b*-2 of the separating claws 6*a*, 6*b*.

Similar to the sheet supply rollers 4*a*, 4*b*, the release cams 5*a*, 5*b* are slidably mounted on a cam shaft 9 in such a manner that a rotational force is transmitted to the release cams via the cam shaft. Thus, by rotating a release lever 10, the rotational force is transmitted to the release cams 5*a*, 5*b* via the cam shaft 9. Further, since the release cams 5*a*, 5*b* are received in the recessed portions or cam receiving portions 3*a*-2, 3*b*-2 of the sheet regulating guides 3*a*, 3*b*, the cams are shifted on the cam shaft 9 in synchronously with the sliding movement of the sheet regulating guides 3*a*, 3*b*.

Ramp plates 7*a*, 7*b* serve to separate and supply thicker sheets such as post cards, envelopes and the like. In the condition that the claw portions 6*a*-2, 6*b*-2 of the separating claws 6*a*, 6*b* are abutted against the pressure plate 2, when the thicker sheets such as post cards, envelopes and the like stacked on the pressure plate are fed out by the sheet supply rollers 4*a*, 4*b*, leading ends of the fed thicker sheets are abutted against inclined surfaces 7*a*-1, 7*b*-1 of the ramp plates 7*a*, 7*b*, with the result that only an uppermost thicker sheet contacted with the sheet supply rollers 4*a*, 4*b* is fed out due to the resistance of the resiliency of the sheet. The ramp plates 7*a*, 7*b* are provided with arms 7*a*-2, 7*b*-2 by which the grooves 4*a*-1, 4*b*-1 of the sheet supply rollers 4*a*, 4*b* are engaged, so that the ramp plates can be shifted synchronously with the sliding movement of the sheet regulating guides 3*a*, 3*b*, similar to the sheet supply rollers 4*a*, 4*b*.

Next, the operation of the sheet feeding apparatus having the above-mentioned arrangement will be explained with reference to FIGS. 3 to 6, in connection with the cases where the plain paper sheets and thicker sheets are used.

Figure 3:
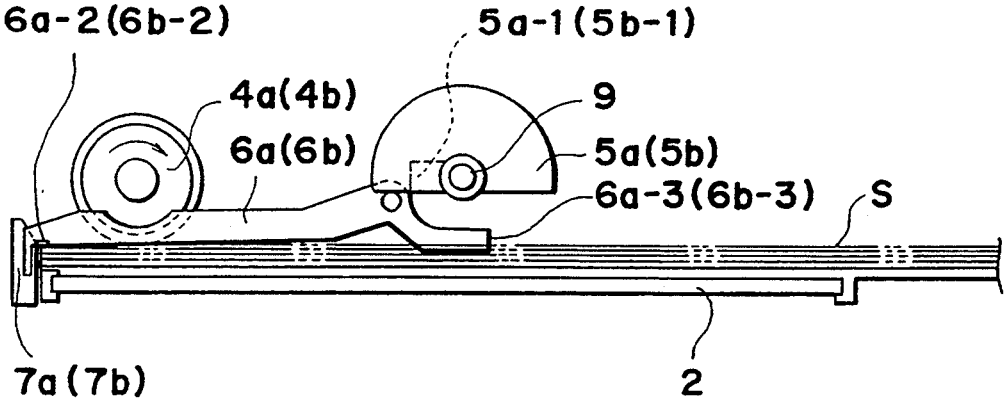
FIG. 3 is an elevational sectional view of the apparatus of FIG. 1, showing a condition that plain paper sheets are supplied.

Normally, in a condition that the plain paper sheets are supplied, as shown in FIG. 3, since the release lever 10 is positioned in a sheet feeding position, the release cams 5*a*, 5*b* driven by the release lever 10 are not abutted against the cam receiving portions 3*a*-2, 3*b*-2 of the sheet regulating guides 3*a*, 3*b* and the push-down portion 6*a*-3, 6*b*-3 of the separating claws 6*a*, 6*b*. Thus, the sheets S are urged against the sheet supply rollers 4*a*, 4*b* by the pressure plate 2 and the front corners of the sheets S are held down by the claw portions. 6*a*-2, 6*b*-2 of the separating claws 6*a*, 6*b*. As a result, when the sheet supply rollers 4*a*, 4*b* are rotated in a direction shown by the arrow the sheet can be fed or supplied one by one.

Figure 4:
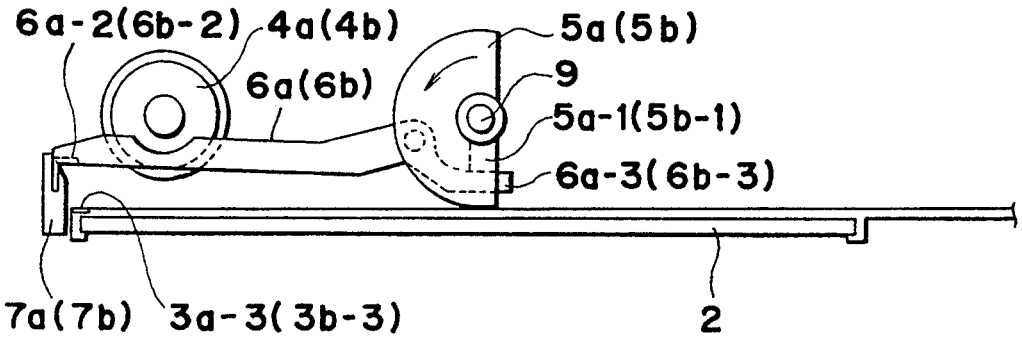
FIG. 4 is an elevational sectional view of the apparatus of FIG. 1, showing a condition that separating claws are separated from a pressure plate.

Now, an operation for setting the sheets S on the pressure plate 2 will be explained. As shown in FIG. 4, first of all, the release lever 10 is rotated so that the release cams 5*a*, 5*b* are rotated in a direction shown by the arrow. When the release cams 5a, 5b are so rotated, the pressure plate 2 is pushed down and the claw portions 6a-2, 6b-2 of the separating claws 6a, 6b are separated from the pressure plate 2 by the claw opening cams 5a-1, 5b-1 on the release cams 5a, 5b to be lifted toward the sheet supply rollers 4a, 4b, thereby establishing the release position. Now, the sheets are set on the pressure plate 2. Then, when the sheet regulating guides 3a, 3b are slid so that a distance between the guides is equal to a width of the sheet, the sheet supply rollers 4a, 4b, separating claws 6a, 6b, release cams 5a, 5b and ramp plates 7a, 7b are also slid synchronously with the sliding movement of the sheet regulating guides because of the engagement between these elements and the guides. In this way, it is possible to accommodate sheets having various widths. When the release cams 5a, 5b are returned to the aforementioned release position by rotating the release lever 10, the front corners of the sheets are held down by the separating claws 6a, 6b and the sheets are urged against the sheet supply rollers 4a, 4b (FIG. 3), thus permitting the feeding of the plain paper sheets.

Figure 5:
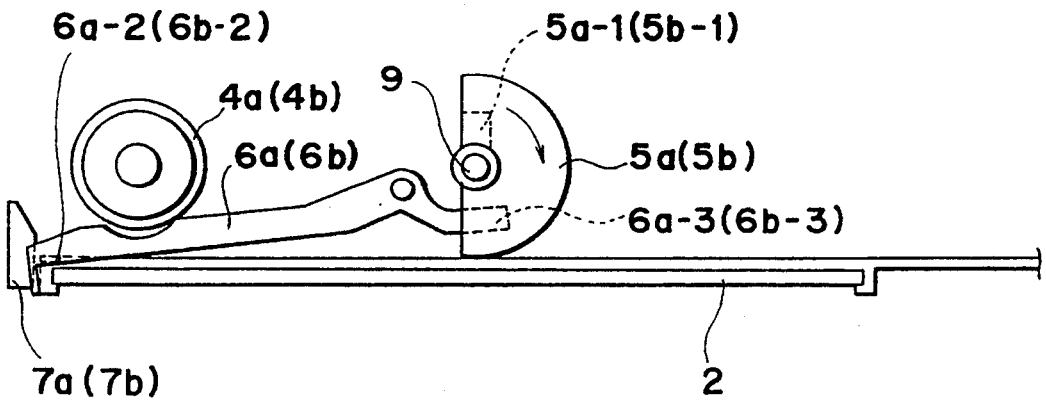
FIG. 5 is an elevational sectional view of the apparatus of FIG. 1, showing a condition that the separating claws are positioned near the pressure plate.

On the other hand, in setting the recording sheets S on the pressure plate 2, when the release lever 10 is rotated so that the release cams 5a, 5b are rotated in a direction shown by the arrow in FIG. 5 opposite to the direction shown in FIG. 4, the claw opening cams 5a-1, 5b-1 of the release cams 5a, 5b are not abutted against the push-down portions 6a-3, 6b-3 of the separating claws 6a, 6b, but push down only the pressure plate 2. In this case, the claw portions 6a-2, 6b-2 of the separating claws 6a, 6b are abutted against the pressure plate 2 by their own weights (separating claw retard condition). In this condition, when the thicker sheets such as post cards, envelopes and the like are set on the pressure plate 2, since the claw portions 6a-2, 6b-2 of the separating claw 6a, 6b are retarded in the recessed portions 3a-3, 3b-3 of the sheet regulating guides 3a, 3b, the sheet can be set on the pressure plate regardless of the existence of the claw portions 6a-2, 6b-2 of the separating claws 6a, 6b. Thereafter, even when the release cams 5a, 5b are returned to the sheet feeding position, the corners of the sheets are not held down by the separating claws 5a, 5b. Thus, when the sheet supply rollers 4a, 4b are rotated, since the sheets are not separated by the separating claws 6a, 6b, but separated by the ramp plates 7a, 7b, it is possible to supply the thicker sheet such as post card, envelope and the like having the greater resiliency.

Figure 6:
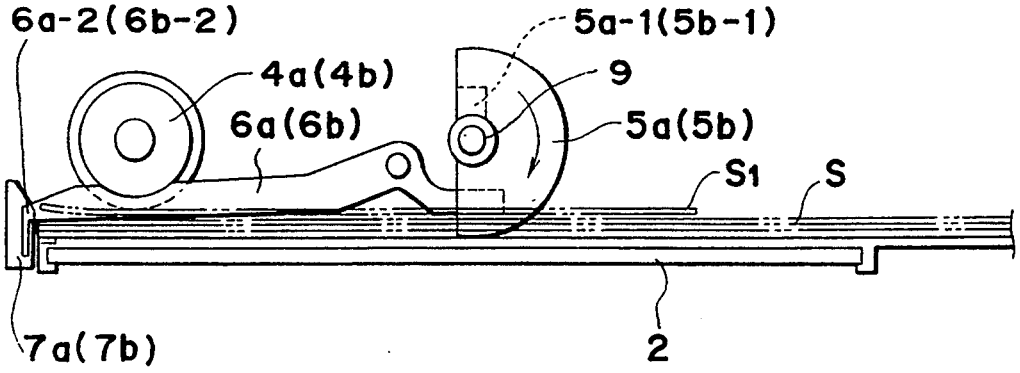
FIG. 6 is an elevational sectional view of the apparatus of FIG. 1, showing a condition that a manual sheet insertion is effected in the case where the plain paper sheets are stacked.

FIG. 6 shows a condition that the sheet is manually supplied or inserted into the sheet feeding apparatus. When the release cams 5a, 5b are rotated in a direction shown by the arrow in FIG. 6 to establish the separating claw retard position in a condition that the sheets S are stacked on the pressure plate 2, the pressure plate 2 is lowered to separate from the sheet supply rollers 4a, 4b while the corners of the sheets S being held down by the claw portions 6a-2, 6b-2 of the separating claws 6a, 6b. Accordingly, in this condition, when another sheet S1 is set on the pressure plate, the set sheet S1 is rested on the claw portions 6a-2, 6b-2 of the separating claws 6a, 6b. Thus, when the release cams 5a, 5b are returned to the sheet feeding position and the sheet supply rollers 4a, 4b are rotated, only the sheet S1 is supplied or fed (manual sheet supply).

Figure 7:
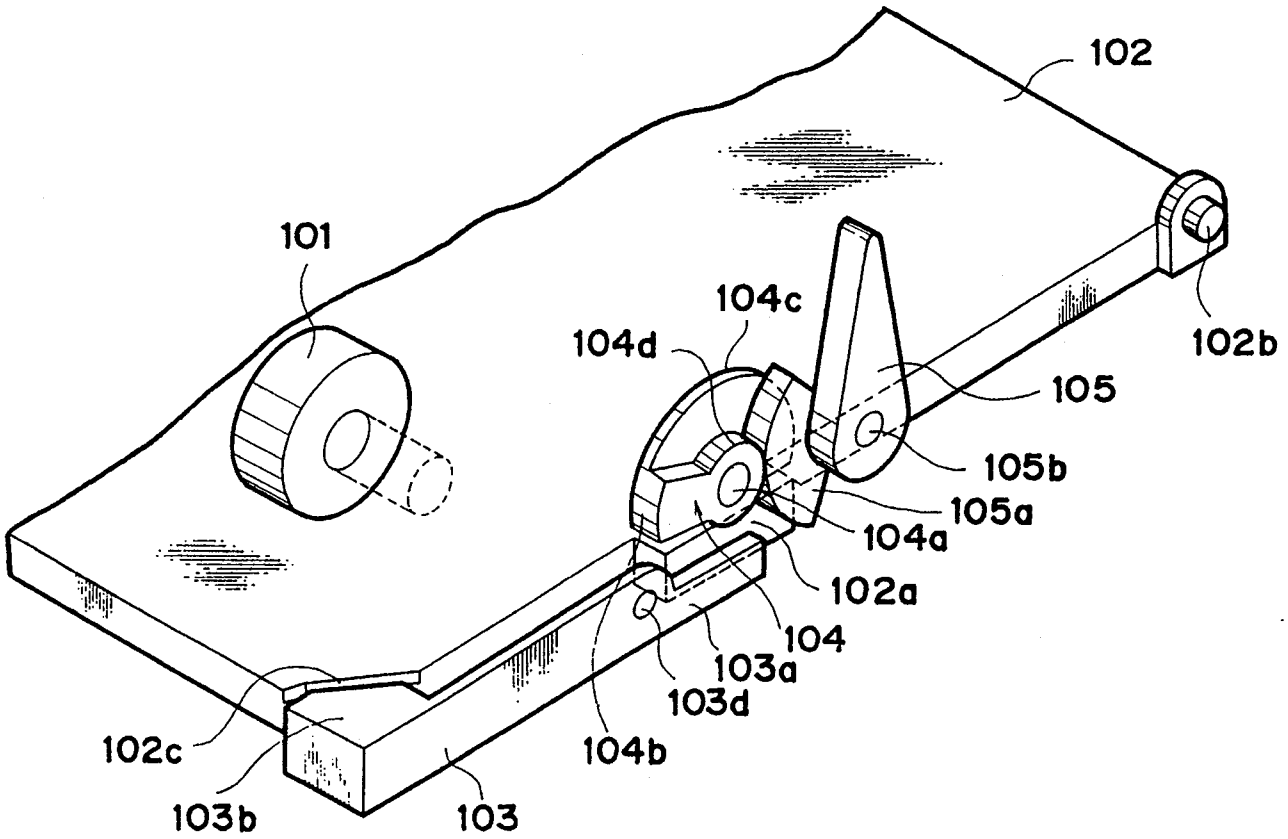
FIG. 7 is a partial perspective view of a sheet feeding apparatus according to another embodiment of the present invention.

FIG. 7 is a perspective view of a sheet feeding apparatus according to a second embodiment of the present invention, wherein a one-sided separating claw is used.

In FIG. 7, the reference numeral 101 denotes a sheet supply roller for feeding out sheets; and 102 denotes a pressure plate for urging the sheets S stacked on this plate against the sheet supply roller 101. The pressure plate 102 is pivotally mounted via pivot pins 102b and is biased toward the sheet supply roller by a pressure spring (not shown). The pressure plate 102 is provided with a projection 102a against which a release cam 104 (described later) can be abutted when the cam is rotated. The projection 102a can be engaged by either cam surface 104b or 104c of the release cam 104 so that the pressure plate can be lowered to separate from the sheet supply roller 101 by the release cam 104. A separating claw 103 is provided at its front corner (in a sheet feeding direction) with a claw portion 103b by which the front corner of the stacked sheets S is held down.

The separating claw 103 is pivotally mounted via a pivot pin 103d and is normally abutted against the pressure plate 102 by its own weight. As in the aforementioned embodiment, also in this embodiment, the separating claw 103 may positively be biased toward the pressure plate 102 by means of a spring and the like. The pressure plate is provided with a recessed portion 102c so that the claw portion 103b of the separating claw 103 such that the claw portion 103b does not protrude from a sheet passing surface of the pressure plate 102 in a condition that claw portion 103b of the separating claw 103 is abutted against the pressure plate 102. Thus, in the condition that the separating claw 103 is abutted against, or adjacent to, the pressure plate 102, even when the sheets are set on the pressure plate, the corner of the stacked sheets is not caught by the claw portion 103b of the separating claw 103. Further, on the other end of the separating claw 103 removed from the claw portion 103b, there is provided a push-down portion 103a against which only the cam surface 104b of the release cam 104 can be abutted. When the push-down portion 103a is pushed down by the release cam 104, the separating claw 103 is rotated around the pivot pin 103d, thereby separating the claw portion 103b (opposite to the push-down portion 103a) of the separating claw 103 from the pressure plate 102 to establish a claw opening condition.

The release cam 104 includes the cam surface or cam portion 104b for rotating the pressure plate 102 and the separating claw 103 simultaneously, and the cam surface or cam portion 104c for rotating the pressure plate 102 alone. The release cam 104 is rotatable around the cam shaft 104a and is provided with a cam gear 104d which is meshed with a lever gear 105a of a release lever 105. The release lever 105 is rotatably mounted via a pivot shaft 105b.

Next, the operation of the sheet feeding apparatus having the above-mentioned arrangement will be explained with reference to FIGS. 8 to 11, in connection with cases where the plain paper sheets and thicker sheets such as post cards, envelopes and the like are used.

Figure 8:
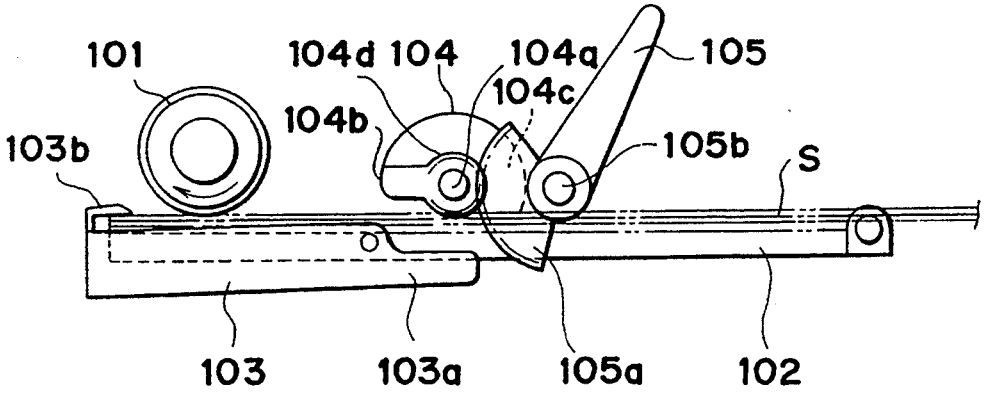
FIG. 8 is an elevational sectional view of the apparatus of FIG. 7, showing a condition that plain paper sheets are supplied.

Normally, in a condition that the plain paper sheets are supplied, as shown in FIG. 8, since the release lever 105 is positioned in a sheet feeding position, both the cam portions 104b and 104c of the release cam 103 driven by the release lever 105 are not abutted against the projection 102a of the pressure plate 102 and the push-down portion 103a of the separating claw 103. Thus, the sheets S are urged against the sheet supply roller 101 by the pressure plate 102 and the front corner of the stacked sheets S is held down by the claw portion 103*b* of the separating claw 103. As a result, when the sheet supply roller 101 is rotated in a direction shown by the arrow, the sheet S can be fed or supplied one by one.

Figure 9:
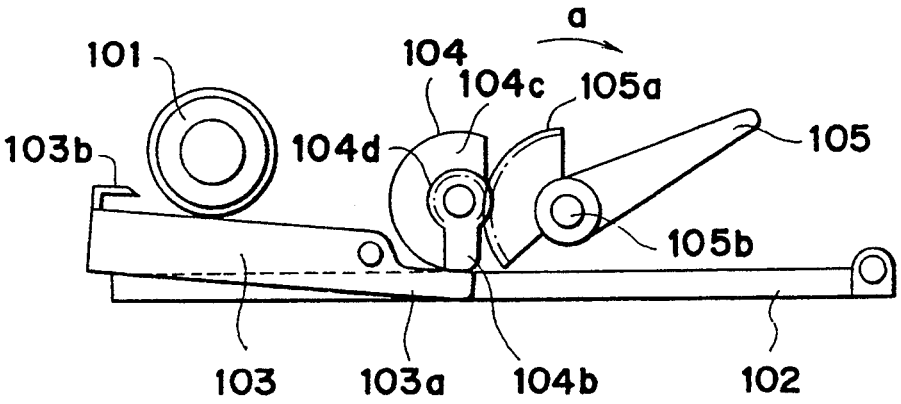
FIG. 9 is an elevational sectional view of the apparatus of FIG. 7, showing a condition that separating claws are separated from a pressure plate.

Now, in setting the sheets S on the pressure plate 102, as shown in FIG. 9, when the release lever 105 is rotated in a direction shown by the arrow a, the release cam gear 104*d* meshed with the lever gear 105*a* is rotated, with the result that the pressure plate 102 is pushed down to separate the sheet supply roller 101 and the claw portion 103*b* of the separating claw 103 is lifted toward the sheet supply roller 101 due to the fact that the opposite push-down portion 103*a* is pushed down, thereby establishing the release position for the separating claw 103. Now, the sheets S are set on the pressure plate 102. Then, when the release lever 105 is returned to the sheet feeding position, the front corner of the stacked sheets S is held down by the separating claw 103, thus permitting the feeding of the plain paper sheets.

Figure 10:
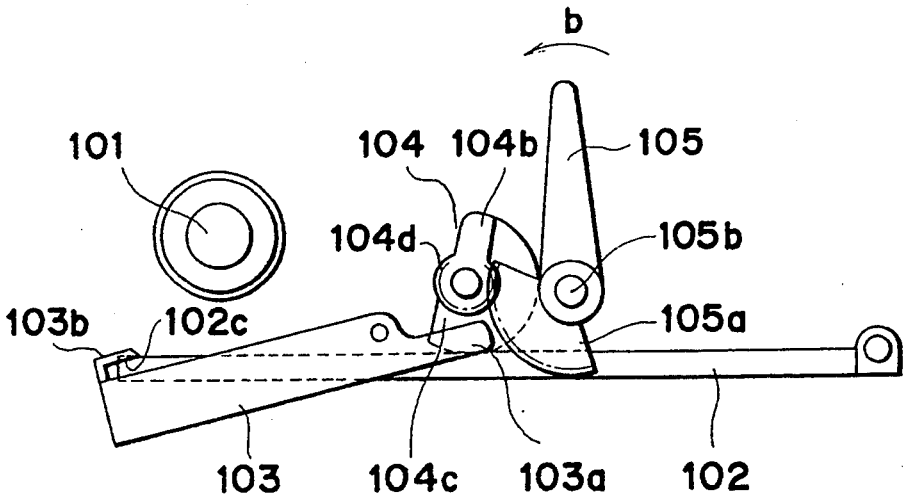
FIG. 10 is an elevational sectional view of the apparatus of FIG. 2, showing a condition that the separating claws are positioned near the pressure plate.

On the other hand, when the release lever 105 is rotated in a direction b as shown in FIG. 10, although the release cam 104 is rotated, since only the cam portion 104*c* is abutted against the projection of the pressure plate 102, the claw portion 103*b* of the separating claw 103 is lowered toward the pressure plate 102 by its own weight (retard condition). In this condition, when the thicker sheets such as post cards, envelopes and the like are set on the pressure plate 102, since the thicker sheets are rested on the retarded claw portion 103*b* of the separating claw 103, even when the release lever 105 is returned to the sheet feeding position, the corner of the sheets is not held down by the separating claw 103. Thus, when the sheet supply roller 101 is rotated, since the claw separation is changed to the direction separation, it is possible to supply the thicker sheets.

Figure 11:
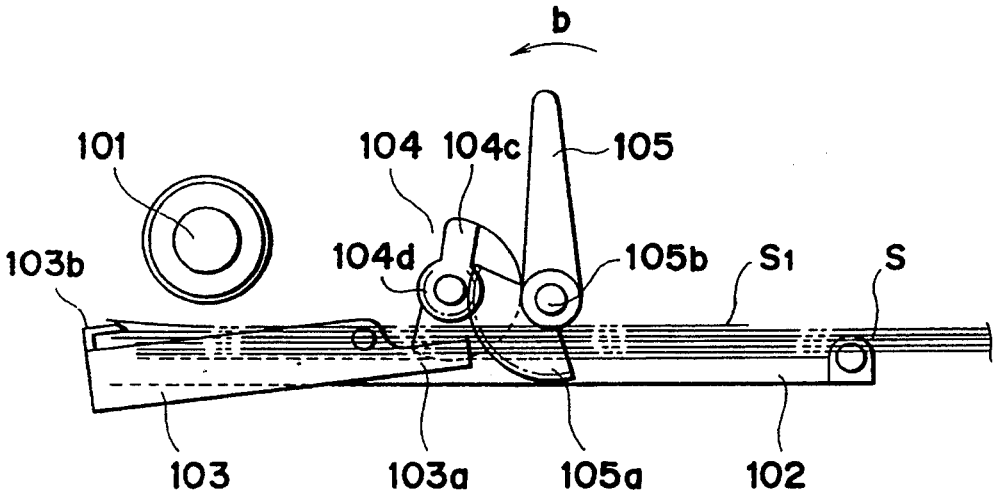
FIG. 11 is an elevational sectional view of the apparatus of FIG. 7, showing a condition that a manual sheet insertion is effected in the case where the plain paper sheets are stacked.

FIG. 11 shows a condition that the sheets are manually inserted one by one. When the release lever 105 is rotated in a direction shown by the arrow b, the pressure plate 102 is lowered while the sheets S being held down by the claw portion 103*b* of the separating claw 103. Accordingly, in this condition, when another sheet S1 is set on the pressure plate, the set sheet S1 is rested on the claw portion 103*b* of the separating claw 103. Thus, when the release lever 105 is returned to the sheet feeding position and the sheet supply roller 101 is rotated, only the sheet S1 is supplied or fed, thus permitting the manual sheet supply. Therefore, since a manual sheet insertion opening is not required, and the manual sheet supply can be effected by using the same sheet supply opening as that for the automatic sheet feeding apparatus, it is possible to make the apparatus small-sized and inexpensive.

In the above-mentioned embodiments, while the release cam or cams were driven by the release lever, in place of the release lever, a release knob may be integrally formed with the cam to rotate the cam or cams directly. Alternatively, the separating claw 103 may be shifted between the release position and the retard position with respect to the pressure plate 102 by the direct rotation of the release lever 105. Although not described in the explanation of the ramp plates, when the one-sided separating claw is used, the ramp plate can be fixed with respect to the widthwise direction of the sheet, or the ramp plate may be integrally formed with the frame. Furthermore, in the embodiment wherein the one-sided separating claw is used, when a sheet reference is provided only in association with the one-sided separating claw, the same reference mechanism at the other side is not required, thus making the apparatus simpler, reducing the number of parts and making the apparatus inexpensive.

Figure 12:
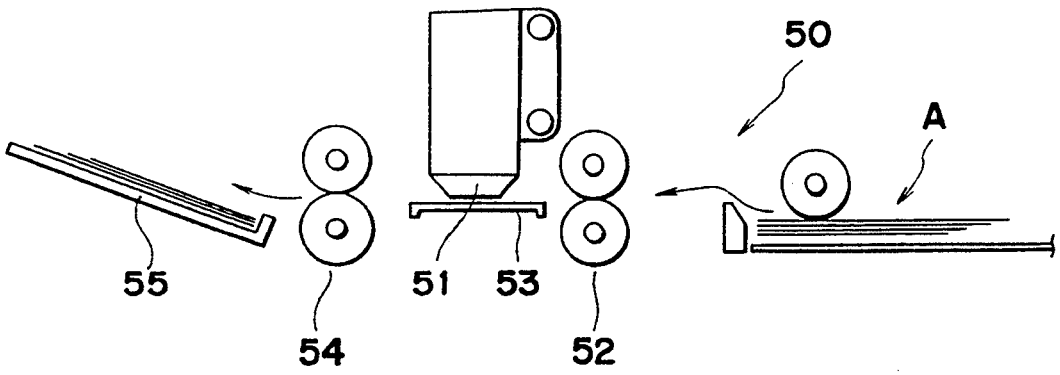
FIG. 12 is a schematic elevational view of an image forming system incorporating the sheet feeding apparatus according to the present invention therein.

FIG. 12 is a constructural view showing an image forming system 50 incorporating therein the sheet feeding apparatus A of one embodiment of the present invention.

An image forming means of this image forming system is of an ink jet type wherein ink is selectively discharged from discharge openings by the growth of bubble(s) generated by the film boiling of ink caused by electrical/thermal converter(s), thereby forming an image.

In FIG. 12, a recording head 51 is mounted on a carriage (not shown) reciprocally shiftable in horizontal directions (perpendicular to a plane of the sheet). The sheet supplied from the sheet feeding apparatus A is fed to a platen 53 by a pair of feed rollers 52, and the image is gradually formed on the sheet by the recording head 51. The sheet on which the image was formed is ejected onto an ejection tray 55 by a pair of ejector rollers 54. In this way, it is possible to form the image on the sheet such as plain paper sheet, post card, envelope and the like supplied from the sheet feeding apparatus A.

Incidentally, the image forming means is not limited to the ink jet type, but may be of other suitable types.

As mentioned above, since the separating claw means can be switched, in synchronously with the releasing operation of the pressure plate, between the retard position where the separating claw means is retarded toward the pressure plate and the position where the separating claw means is separated from the pressure plate, it is possible not only to supply both the plain paper sheet and the thicker sheet such as post card, envelope and the like, but also to manually supply a sheet in the retard position, with the single sheet feeding mechanism.

Incidentally, while an example that the thicker sheets are separated by the ramp plate(s) was explained in the above-mentioned embodiments, the present invention is not limited to this example, but other separation mechanisms (for example, comprising a separation pad having a greater coefficient of friction and a drive roller urged against the separation pad) may be used.

Further, while the release lever 10, 105 was rotated manually, the release lever may be automatically rotated by a reversible motor and the like.

What is claimed is:

1. A sheet feeding apparatus comprising:

sheet supporting means for supporting sheets;

supply means for feeding the sheets supported by said sheet supporting means in a sheet feeding direction;

a separating claw for separating, one-by-one, the sheets fed by said supply means while in a separating position by regulating a front edge of the sheets relative to the sheet feeding direction, said separating claw switchable to a remote position where it is remote from said supporting means to allow loading of the sheets;

switching means for switching positions of said separating claw between the separating position and the remote position; and separating means for separating, one-by-one, the sheets fed by said supply means when said separating claw is in a wait position where it is located below the stacked sheets.

2. A sheet feeding apparatus according to claim 1, wherein said separating claw can be shifted between the separating and remote positions in a sheet stacking direction, and wherein said switching means includes a regulating member for regulating said separating claw to assume the remote position at which the sheets are loaded on said sheet supporting means, said separating claw regulating the front corners of the sheets after said regulating member has released said separating claw from the remote position.

3. A sheet feeding apparatus according to claim 1, wherein said separating claw is pivotable.

4. A sheet feeding apparatus according to claim 1, wherein said separating claw has a claw portion, and wherein said sheet supporting means includes a sheet supporting surface having a recess, the recess for receiving said claw portion such that said claw portion does not protrude from the sheet supporting surface of said sheet supporting means when said separating claw is in the wait position.

5. A sheet feeding apparatus according to claim 1, wherein said separating claw is disposed at a single side of the front corners of the sheets supported by said sheet supporting means.

6. A sheet feeding apparatus according to claim 1, wherein said separating claw is positioned in the wait position by said separating claw's own weight.

7. A sheet feeding apparatus according to claim 1, wherein said separating means comprises a ramp surface against which leading ends of the sheets fed by said supply means are abutted, and by which the sheets are separated one-by-one by causing a sheet to ride over said ramp surface.

8. A sheet feeding apparatus comprising:

a sheet supporting means for supporting sheets;

supply means for feeding the sheets supported by said sheet supporting means in a sheet feeding direction;

biasing means for urging the sheets supported by said sheet supporting means against said supply means;

a separating claw for separating, one-by-one, the sheets fed by said supply means while in a separating position by regulating a front edge of the sheets relative to the a sheet feeding direction, said separating claw switchable to a remote position where it is remote from said supporting means to allow for loading of the sheets;

switching means for switching positions of said separating claw between the separating position and the remote position; and separating means for separating, one-by-one, the sheets fed by said supply means when said separating claw is positioned in a wait position where it is located below the stacked sheets so as not to separate them.

9. A sheet feeding apparatus according to claim 8, wherein said separating claw can be shifted between the separating and remote positions in a sheet stacking direction, and wherein said switching means includes a regulating member for regulating said separating claw to assume the separating position when the urging of the sheets against said supply means is released by said pressure releasing means.

10. A sheet feeding apparatus according to claim 9, wherein said pressure releasing means comprises a cam means for separating, by a rotation of said cam means, said sheet support from said supply means in opposition to a biasing force of said biasing means.

11. A sheet feeding apparatus according to claim 10, wherein said separating claw is maintained in the remote position by said regulating member in response to the releasing of the urging by said cam means.

12. A sheet feeding apparatus according to claim 11, wherein said cam means includes a lever for rotating said cam means.

13. A sheet feeding apparatus according to claim 12, wherein a rotation of said lever in a first direction causes said cam means to release the urging and causes said regulating member to position said separating claw in the remote position and a rotation of said lever in a second direction causes said cam means to release the urging and causes said regulating member to shift said separating claw to the wait position.

14. A sheet feeding apparatus according to claim 8, wherein said separating claw is positioned in the wait position by said supporting claw's own weight.

15. A sheet feeding apparatus according to claim 8, wherein said separating claw has a claw portion, and wherein said sheet supporting means includes a sheet supporting surface having a recess, the recess for receiving said claw portion such that said claw portion does not protrude from the sheet supporting surface of said sheet supporting means when said separating claw is in the wait position.

16. A sheet feeding apparatus according to claim 8, wherein said separating claw is disposed at a single side of the front corners of the sheets supported by said sheet supporting means.

17. A sheet feeding apparatus according to claim 8, wherein said separating claw comprises a ramp surface against which leading ends of the sheets fed by said supply means are abutted, and by which the sheets are separated one-by-one by causing a sheet to ride over said ramp surface.

18. An image forming apparatus comprising:

sheet supporting means for supporting sheets;

supply means for feeding the sheets supported by said sheet supporting means in a sheet feeding direction;

a separating claw for separating, one-by-one, the sheets fed by said supply means while in a separating position by regulating a front edge of the sheets relative to a sheet feeding direction, said separating claw switchable to a remote position where it is remote from said supporting means to allow for loading of the sheets;

switching means for switching positions of said separating claw between the separating position and the remote position;

separating means for separating, one-by-one, the sheets fed by said supply means when said separating claw is positioned in a wait position where it is located below the stacked sheets; and image forming means for forming an image on the sheet separated by one of said separating claw and said separating means.

19. An image forming apparatus according to claim 18, wherein said separating means separates sheets which have a rigidity greater than that of the sheets separated by said separating claw.

20. An image forming apparatus according to claim 19, wherein said image forming means comprises an ink jet type in which ink is discharged by a growth of a bubble caused by film boiling of the ink to form the image.

21. An image forming apparatus comprising:

a sheet supporting means for supporting sheets;

supply means for feeding the sheets supported by said sheet supporting means in a sheet feeding direction;

biasing means for urging the sheets supported by said sheet supporting means against said supply means;

a separating claw for separating, one-by-one, the sheets fed by said supply means while in a separating position by regulating a front edge of the sheets relative to the sheet feeding direction, said separating claw switchable to a remote position where it is remote from said supporting means to allow for loading of the sheets;

switching means for switching positions of said separating claw between the separating position and the remote position;

separating means for separating, one-by-one, the sheets fed by said supply means when said separating claw is positioned in a wait position where it is located below the stacked sheets so as not to separate them; and image forming means for forming an image on the sheet separated by one of said separating claw means and said separation means.

22. An image forming apparatus according to claim 21, wherein said separating means separates sheets which have a rigidity greater than that of the sheets separated by said separating claw.

23. An image forming apparatus according to claim 22, wherein said image forming means comprises an ink jet type in which ink is discharged by a growth of a bubble caused by film boiling of the ink to form the image.

24. A sheet feeding apparatus, comprising:

sheet supporting means for supporting sheets;

supply means for feeding the sheets supported by said sheet supporting means in a sheet feeding direction;

a separating claw for separating, one-by-one, the sheets fed by said supply means by regulating a front edge of the sheets relative to the sheet feeding direction;

switching means for shifting said separating claw between a separating position where said separating claw regulates the sheets supported on said sheet supporting means, and a waiting position where said separating claw does not regulate the sheets, said separating claw being located under the sheets supported by said supporting means when said separating claw is in the waiting position; and separating means for separating, one-by-one, the sheets fed by said supply means when said separating claw is shifted to the waiting position by said switching means.

25. A sheet feeding apparatus according to claim 24, wherein said separating claw has a claw portion, and wherein said sheet supporting means includes a sheet supporting surface having a recess, the recess for receiving said claw portion such that said claw portion does not protrude from the sheet supporting surface of said sheet supporting means when said separating claw is in the waiting position.

26. A sheet feeding apparatus according to claim 24, wherein said separating means separates sheets which have a rigidity greater than that of the sheets separated by said separating claw.

27. An image forming apparatus, comprising:

sheet supporting means for supporting sheets;

supply means for feeding the sheets supported by said sheet supporting means in a sheet feeding direction;

a separating claw for separating, one-by-one, the sheets fed by said supply means by regulating a front edge of the sheets relative to the sheet feeding direction;

switching means for shifting said separating claw between a separating position where said separating claw regulates the sheets supported on said sheet supporting means, and a waiting position where said separating claw does not regulate the sheets, said separating claw being located under the sheets supported by said supporting means when said separating claw is in the waiting position;

separating means for separating, one-by-one, the sheets fed by said supply means when said separating claw is shifted to the waiting position by said switching means; and image forming means for forming an image on the sheet separated by one of said separating claw and said separating means.

28. A sheet feeding apparatus, comprising:

sheet supporting means for supporting sheets;

supply means for feeding the sheets supported by said sheet supporting means in a sheet feeding direction;

biasing means for urging the sheets supported by said sheet supporting means against said supply means;

pressure releasing means for releasing the urging force against said supply means by said biasing means;

a separating claw for separating, one-by-one, the sheets fed by said supply means while in a separating position by regulating a front edge of the sheets relative to the sheet feeding direction, said separating claw switching to a remote position at which said separating claw is remote from said sheet supporting means to allow for loading of the sheets;

first switching means for switching said separating claw between the remote position and the separating position;

second switching means for switching said separating claw between the separating position and a wait position where it is located below the stacked sheets so as not to separate them; and separating means for separating, one-by-one, the sheets fed by said supply means when said separating claw is in the waiting position.

29. A sheet feeding apparatus according to claim 28, wherein said second switching means is operated when said separating means separates sheets which have a rigidity greater than that of the sheets separated by said separating claw.

30. An image forming apparatus, comprising:

sheet supporting means for supporting sheets;

supply means for feeding the sheets supported by said sheet supporting means in a sheet feeding direction;

biasing means for urging the sheets supported by said sheet supporting means against said supply means;

pressure releasing means for releasing the urging force against said supply means by said biasing means;

a separating claw for separating, one-by-one, the sheets fed by said supply means while in a separating position by regulating a front edge of the sheets relative to the sheet feeding direction, said separating claw switching to a remote position at which said separating claw is remote from said sheet supporting means to allow for loading of the sheets;

first switching means for switching said separating claw between the remote position and the separating position;

second switching means for switching said separating claw between the separating position and a wait position where it is located below the stacked sheets so as not to separate them;

separating means for separating, one-by-one, the sheets fed by said supply means when said separating claw is in the waiting position; and image forming means for forming an image on the sheet separated by one of said separating claw and said separating means.

31. A sheet feeding apparatus comprising:

sheet supporting means for supporting sheets;

supply means for feeding the sheets supported by said sheet supporting means in a sheet feeding direction;

a separating claw for separating the sheets fed by said supply means one-by-one, said separating claw switchable among a separating position for regulating a front edge of the sheets to separate the sheets, a non-separating position so as not to regulate the front edge of the sheets, and a sheet loading position for allowing loading of the sheets;

switch means for switching said separating claw among the separating position, non-separating position and sheet loading position; and separating means for separating the sheets fed by said supply means, one-by-one, when said separating claw is switched to the non-separating position by said switching means.

32. An image forming apparatus comprising:

sheet supporting means for supporting sheets;

supply means for feeding the sheets supported by said sheet supporting means in a sheet feeding direction;

a separating claw for separating the sheets fed by said supply means, one-by-one, said separating claw switchable among a separating position for regulating a front edge of the sheets to separate the sheets, non-separating position so as not to regulate the front edge of the sheets, and a sheet loading position for allowing loading of the sheets;

switch means for switching said separating claw among the separating position, non-separating position and sheet loading position;

separating means for separating the sheets fed by said supply means, one-by-one, when said separating claw is switched to the non-separating position by said switching means; and image forming means for forming an image on the sheet separated by said separating claw or separating means.

* * * * *

UNITED STATES PATENT AND TRADEMARK OFFICE

CERTIFICATE OF CORRECTION

PATENT NO. : 5,370,380

DATED : December 6, 1994

INVENTOR(S) : TETSUO SUZUKI, ET AL.

It is certified that error appears in the above-indentified patent and that said Letters Patent is hereby corrected as shown below:

Column [56] RC,
line FPD "2276737 11/1990 Japan" should read --2-276737 11/1990 Japan--.

Column 1,
line 67, "a" should read --an--.

Column 2,
line 1, "prevent" should read --present--.

Column 4,
line 9, "6*b*-2;" should read --6*b*-2--; and
line 27, "in" should be deleted.

Column 6,
line 24, "so that" should read --for receiving--.

Column 7,
line 40, "being" should read --are--.

Column 8,
line 29, "in" should be deleted.

UNITED STATES PATENT AND TRADEMARK OFFICE

CERTIFICATE OF CORRECTION

PATENT NO. : 5,370,380

DATED : December 6, 1994

INVENTOR(S) : TETSUO SUZUKI, ET AL.

It is certified that error appears in the above-indentified patent and that said Letters Patent is hereby corrected as shown below:

Column 9,
line 43, "a" should be deleted.

Column 11,
line 22, "means" (first occurrence) should be deleted, and "separation" should read --separating--.

Column 14,
line 16, "non-separating" should read --a non-separating--.

Signed and Sealed this

Thirtieth Day of May, 1995

Bruce Lehman

*Attest:*

BRUCE LEHMAN

*Attesting Officer*

*Commissioner of Patents and Trademarks*